US008271248B2

(12) United States Patent
Pomerantz et al.

(10) Patent No.: US 8,271,248 B2
(45) Date of Patent: Sep. 18, 2012

(54) METHODS AND APPARATUS FOR CHARACTERIZATION OF PETROLEUM FLUIDS AND APPLICATIONS THEREOF

(75) Inventors: Andrew E. Pomerantz, Lexington, MA (US); Julian Zuo, Edmonton (CA); Christopher Harrison, Auburndale, MA (US); Oliver C. Mullins, Ridgefield, CT (US)

(73) Assignee: Schlumberger Technology Corporation, Sugar Land, TX (US)

( * ) Notice: Subject to any disclaimer, the term of this patent is extended or adjusted under 35 U.S.C. 154(b) by 317 days.

(21) Appl. No.: 12/752,967

(22) Filed: Apr. 1, 2010

(65) Prior Publication Data

US 2011/0246143 A1 Oct. 6, 2011

(51) Int. Cl.
*G06G 7/50* (2006.01)
*G06G 7/48* (2006.01)

(52) U.S. Cl. ..... 703/10

(58) Field of Classification Search ..... 703/9; 702/11, 702/10

See application file for complete search history.

(56) References Cited

U.S. PATENT DOCUMENTS

| | | | | |
|---|---|---|---|---|
| 4,994,671 | A | 2/1991 | Safinya et al. | |
| 7,379,819 | B2 * | 5/2008 | Betancourt et al. | 702/11 |
| 7,526,953 | B2 | 5/2009 | Goodwin et al. | |
| 2007/0143023 | A1 * | 6/2007 | Betancourt et al. | 702/11 |
| 2009/0166085 | A1 | 7/2009 | Ciglenec et al. | |
| 2009/0192768 | A1 | 7/2009 | Zuo et al. | |
| 2009/0235731 | A1 | 9/2009 | Zuo et al. | |
| 2009/0248310 | A1 * | 10/2009 | Zuo et al. | 702/11 |
| 2009/0312997 | A1 * | 12/2009 | Freed et al. | 703/10 |

OTHER PUBLICATIONS

Chung Ting-Horng, "Thermodynamic Modeling for Organic Solid Precipitation" Dec. 1992, National Institute for Petroleum and Energy Research; http://www.osti.gov/bridge/servlets/purl/7139224-vly9lw/7139224.pdf.*

Li and Johns, "Rapid Flash Calculations for Compositional Simulation", Oct. 2008 SPE Reservoir Evaluation & Engineering, pp. 521-529.

Lin et al, "The Effects of Asphaltenes on the Chemical and Physical Characteristics of Asphalt, Asphaltenes: Fundamentals and Applications", Edited ty E.Y. Sheu and O.C. Mulliins, Plenum Press, New York, 1995, pp. 155-176.

Pomerantz et el, "Combining Biomarker and Bulk Compositional Gradient Analysis to Assess Reservoir Connectivity", Submitted to Organic Geochemistry (MS#0G-871) Jul. 10, 2009, Revised Manuscript submitted Nov. 20, 2009.

Julian Y. Zuo, Oliver C. Mullins, Chengli Dong, Soraya S. Betancourt, Francois X. Dubost, Michael O'Keefe, Dan Zhang—SPE124624, Investigation of Formation Connectivity Using Asphaltene Gradient Log Predctions Coupled With Downhole Fluid Analysis, pp. 1-11, SPE Annual Technical Conference and Exhibition held in New Orleans, Lousiana, USA, Oct. 4-7, 2009.

Julian Y. Zuo, Dan Zhang, Francois Dubost, Chengli Dong, Oliver C. Mullins, Michael O'Keefe, Soraya S. Betancourt—SPE114702, EOS-Based Downhole Fluid Characterization, pp. 1-8, SPE Asia Pacific Oil & Gas Conference and Exhibition held in Perth, Australia, Oct. 20-22, 2008.

* cited by examiner

*Primary Examiner* — David Silver

(74) *Attorney, Agent, or Firm* — Jay P. Sbrollini; Wayne I. Kanak

(57) ABSTRACT

An improved method that performs downhole fluid analysis of the fluid properties of a reservoir of interest and that characterizes the reservoir of interest based upon such downhole fluid analysis.

25 Claims, 5 Drawing Sheets

METHODS AND APPARATUS FOR CHARACTERIZATION OF PETROLEUM FLUIDS AND APPLICATIONS THEREOF

BACKGROUND OF THE INVENTION

1. Field of the Invention

The present invention relates to methods and apparatus for characterizing petroleum fluids extracted from a hydrocarbon bearing geological formation. The invention has application to reservoir architecture understanding, although it is not limited thereto.

2. Description of Related Art

Petroleum consists of a complex mixture of hydrocarbons of various molecular weights, plus other organic compounds. The exact molecular composition of petroleum varies widely from formation to formation. The proportion of hydrocarbons in the mixture is highly variable and ranges from as much as 97 percent by weight in the lighter oils to as little as 50 percent in the heavier oils and bitumens. The hydrocarbons in petroleum are mostly alkanes (linear or branched), cycloalkanes, aromatic hydrocarbons, or more complicated chemicals like asphaltenes. The other organic compounds in petroleum typically contain carbon dioxide ($CO_2$), nitrogen, oxygen, and sulfur, and trace amounts of metals such as iron, nickel, copper, and vanadium.

The alkanes, also known as paraffins, are saturated hydrocarbons with straight or branched chains which contain only carbon and hydrogen and have the general formula $C_nH_{2n+2}$. They generally have from 5 to 40 carbon atoms per molecule, although trace amounts of shorter or longer molecules may be present in the mixture. The alkanes include methane ($CH_4$), ethane ($C_2H_6$), propane ($C_3H_8$), i-butane ($iC_4H_{10}$), n-butane ($nC_4H_{10}$), i-pentane ($iC_5H_{12}$), n-pentane ($nC_5H_{12}$), hexane ($C_6H_{14}$), heptane ($C_7H_{16}$), octane ($C_8H_{18}$), nonane ($C_9H_{20}$), decane ($C_{10}H_{22}$), hendecane ($C_{11}H_{24}$)— also referred to as endecane or undecane, dodecane ($C_{12}H_{26}$), tridecane ($C_{13}H_{28}$), tetradecane ($C_{14}H_{30}$), pentadecane ($C_{15}H_{32}$) and hexadecane ($C_{16}H_{34}$).

The cycloalkanes, also known as napthenes, are saturated hydrocarbons which have one or more carbon rings to which hydrogen atoms are attached according to the formula $C_nH_{2n}$. Cycloalkanes have similar properties to alkanes but have higher boiling points. The cycloalkanes include cyclopropane ($C_3H_6$), cyclobutane ($C_4H_8$), cyclopentane ($C_5H_{10}$), cyclohexane ($C_6H_{12}$), cycloheptane ($C_7H_{14}$), etc.

The aromatic hydrocarbons are unsaturated hydrocarbons which have one or more planar six-carbon rings called benzene rings, to which hydrogen atoms are attached with the formula $C_nH_n$. They tend to burn with a sooty flame, and many have a sweet aroma. Some are carcinogenic. The aromatic hydrocarbons include benzene ($C_6H_6$) and derivatives of benzene as well as polyaromatic hydrocarbons.

Asphaltenes consist primarily of carbon, hydrogen, nitrogen, oxygen, and sulfur, as well as trace amounts of vanadium and nickel. The C:H ratio is approximately 1:1.2, depending on the asphaltene source. Asphaltenes have been shown to have a distribution of molecular masses in the range of 400 grams/mol to 1500 grams/mol with a maximum around 750 grams/mol. The chemical structure of asphaltene is difficult to ascertain due to its complex nature, but has been studied by existing techniques. It is undisputed that asphaltene is composed mainly of polyaromatic carbon i.e. polycondensed aromatic benzene units with nitrogen, sulfur, and oxygen (NSO-compounds) combined with minor amounts of a series of heavy metals, particularly vanadium and nickel which occur in porphyrin structures. Asphaltenes are today widely recognized as soluble, chemically altered fragments of kerogen which migrated out of the source rock for the oil during oil catagenesis. Asphaltenes are dispersed in reservoir petroleum fluids as nanoaggregates. Heavy oils and tar sands contain much higher proportions of asphaltenes than do medium-API oils or light oils. Condensates are virtually devoid of asphaltenes.

Computer-based modeling and simulation techniques have been developed for estimating the properties and/or behavior of petroleum fluid in a reservoir of interest. Typically, such techniques employ an equation of state (EOS) model that represents the phase behavior of the petroleum fluid in the reservoir. Once the EOS model is defined, it can be used to compute a wide array of properties of the petroleum fluid of the reservoir, such as: gas-oil ratio (GOR) or condensate-gas ratio (CGR), density of each phase, volumetric factors and compressibility, and heat capacity and saturation pressure (bubble or dew point). Thus, the EOS model can be solved to obtain saturation pressure at a given temperature. Moreover, GOR, CGR, phase densities, and volumetric factors are byproducts of the EOS model. Transport properties, such as heat capacity and viscosity, can be derived from properties obtained from the EOS model, such as fluid composition. Furthermore, the EOS model can be extended with other reservoir evaluation techniques for compositional simulation of flow and production behavior of the petroleum fluid of the reservoir, as is well know in the art. For example, compositional simulations can be helpful in studying (1) depletion of a volatile oil or gas condensate reservoir where phase compositions and properties vary significantly with pressure below bubble or dew point pressures, (2) injection of non-equilibrium gas (dry or enriched) into a black oil reservoir to mobilize oil by vaporization into a more mobile gas phase or by condensation through an outright (single-contact) or dynamic (multiple-contact) miscibility, and (3) injection of $CO_2$ into an oil reservoir to mobilize oil by miscible displacement and by oil viscosity reduction and oil swelling.

In the past, fluid homogeneity in a hydrocarbon reservoir has been assumed. However, there is now a growing awareness that fluids are often heterogeneous or compartmentalized in the reservoir. A compartmentalized reservoir consists of two or more compartments that effectively are not in hydraulic communication. Two types of reservoir compartmentalization have been identified, namely vertical and lateral compartmentalization. Vertical compartmentalization usually occurs as a result of faulting or stratigraphic changes in the reservoir, while lateral compartmentalization results from barriers to horizontal flow.

Molecular and thermal diffusion, natural convection, biodegradation, adsorption, and external fluxes can also lead to non-equilibrium hydrocarbon distribution in a reservoir.

Reservoir compartmentalization, as well as non-equilibrium hydrocarbon distribution, can significantly hinder production and can make the difference between an economically-viable field and an economically-nonviable field. Techniques to aid an operator to accurately describe reservoir compartments and their distribution, as well as non-equilibrium hydrocarbon distribution, can increase understanding of such reservoirs and ultimately raise production.

Conventionally, reservoir architecture (i.e., reservoir compartmentalization as well as non-equilibrium hydrocarbon distribution) has been determined utilizing pressure-depth plots and pressure gradient analysis with traditional straight-line regression schemes. This process may, however, be misleading as fluid compositional changes and compartmentalization yield distortions in the pressure gradients, which result in erroneous interpretations of fluid contacts or pressure seals. Additionally, pressure communication does not prove flow connectivity.

US Patent Application Publication No. 2009/0248310, incorporated herein by reference, provides a methodology for determining reservoir architecture employing downhole fluid analysis in conjunction with EOS models that estimate gradients of a number of compositional components in a reservoir as a function of depth due to gravitational forces, chemical forces, and thermal diffusions. Particularly, an estimate of an asphaltene component (i.e., weight fraction of n-heptane insoluble asphaltene) is derived from the EOS model and used in conjunction with an empirical correlation between the asphaltene component estimate and optical absorption measurement data to make a determination related to reservoir architecture.

In some instances, it can be difficult to derive an EOS model that accurately reflects compositional components in a reservoir as a function of depth. In these circumstances, it can become necessary to acquire and analyze more downhole samples in order to refine or tune the EOS model and the resulting determinations based thereon.

However, it is often difficult to assess the accuracy of the EOS model and the resulting determinations based thereon at any given time, and thus know whether or not there is a need to acquire and analyze more downhole samples in order to refine or tune the EOS model and the resulting determinations based thereon.

BRIEF SUMMARY OF THE INVENTION

The present invention therefore provides methods and apparatus that accurately characterize compositional components and fluid properties at varying locations in a reservoir in order to allow for accurate reservoir architecture analysis (e.g., detection of compartmentalization and/or non-equilibrium hydrocarbon distribution in the reservoir of interest).

The invention also provides methods and apparatus that derive measurements for compositional components and other fluid properties at varying locations of the reservoir as derived from downhole fluid measurements and that predict particular fluid properties (preferably fluid density and/or fluid viscosity) at varying locations in a reservoir and utilize such predictions to compare against the downhole measurements associated therewith as a quantitative consistency check to verify the accuracy (or confidence level) of the measurements of compositional components and possibly other fluid properties of the reservoir and for reservoir analysis.

Further, the present invention provides methods and apparatus for interpreting downhole fluid measurements to predict fluid density and/or fluid viscosity at varying locations in a reservoir based upon estimates of asphaltene content (and preferably other fluid properties such as GOR, temperature, and pressure) at such locations.

Accordingly, a downhole fluid analysis tool is employed to obtain and perform downhole fluid analysis of live oil samples at multiple measurement stations within a wellbore traversing a reservoir of interest. Such downhole fluid analysis measures compositional components (including asphaltene content and GOR) and possibly other fluid properties of each live oil sample (including temperature and pressure). The downhole measurements can be used in conjunction with an EOS model to predict gradients of the compositional components (including asphaltene and GOR) as well as other fluid properties for reservoir analysis. At least one model is provided that characterizes the relationship between a particular fluid property, asphaltene content, and GOR (and possibly other properties such as temperature and pressure) at different measurement stations. The model is used to calculate a predicted value of the particular fluid property for at least one given measurement station. The model is based on the assumption that the fluid of the reservoir is connected (i.e., lack of compartmentalization) and is in thermodynamic equilibrium. A consistency check is performed that involves comparison of the predicted value of the particular fluid property for the at least one given measurement station with the corresponding fluid property measured by the downhole fluid analysis for the at least one given measurement station. The results of the consistency check are used for reservoir analysis. For example, the results of the consistency check can be used to determine that the reservoir is connected and in thermal equilibrium, or to determine that the reservoir is compartmentalized or not in thermodynamic equilibrium. The results of the consistency check can also be used to identify tool failure conditions. The results of the consistency check can also be used to determine whether or not to include one or more additional measurement stations in the analysis workflow (and possibly refine or tune the models of the workflow based on the measurements for the additional measurement stations) for better accuracy and confidence in the fluid measurements and predictions that are used for the reservoir analysis.

In one embodiment, the at least one model that characterizes the relationship between a particular fluid property, asphaltene content, GOR (and possibly other properties such as temperature and pressure) at different measurement stations includes a first model that characterizes the relationship between fluid density, asphaltene content, GOR, temperature, and pressure at different measurement stations and/or a second model that characterizes the relationship between fluid viscosity, asphaltene content, and GOR, at different measurement stations. In this embodiment, the consistency check determines whether the asphaltene content and GOR measurements at different measurement stations are consistent with the fluid density and/or fluid viscosity measurements at such measurement stations, and the results of the consistency check are used for reservoir analysis. The results of the consistency check can also be used to determine whether or not to include one or more additional measurement stations in the analysis workflow (and possibly refine or tune the models of the workflow based on the measurements for the additional measurement stations) for better accuracy and confidence in the fluid measurements and predictions that are used for the reservoir analysis. Embodiments of such models are set forth in detail below.

Additional objects and advantages of the invention will become apparent to those skilled in the art upon reference to the detailed description taken in conjunction with the provided figures.

DETAILED DESCRIPTION OF THE INVENTION

Figure 1A:
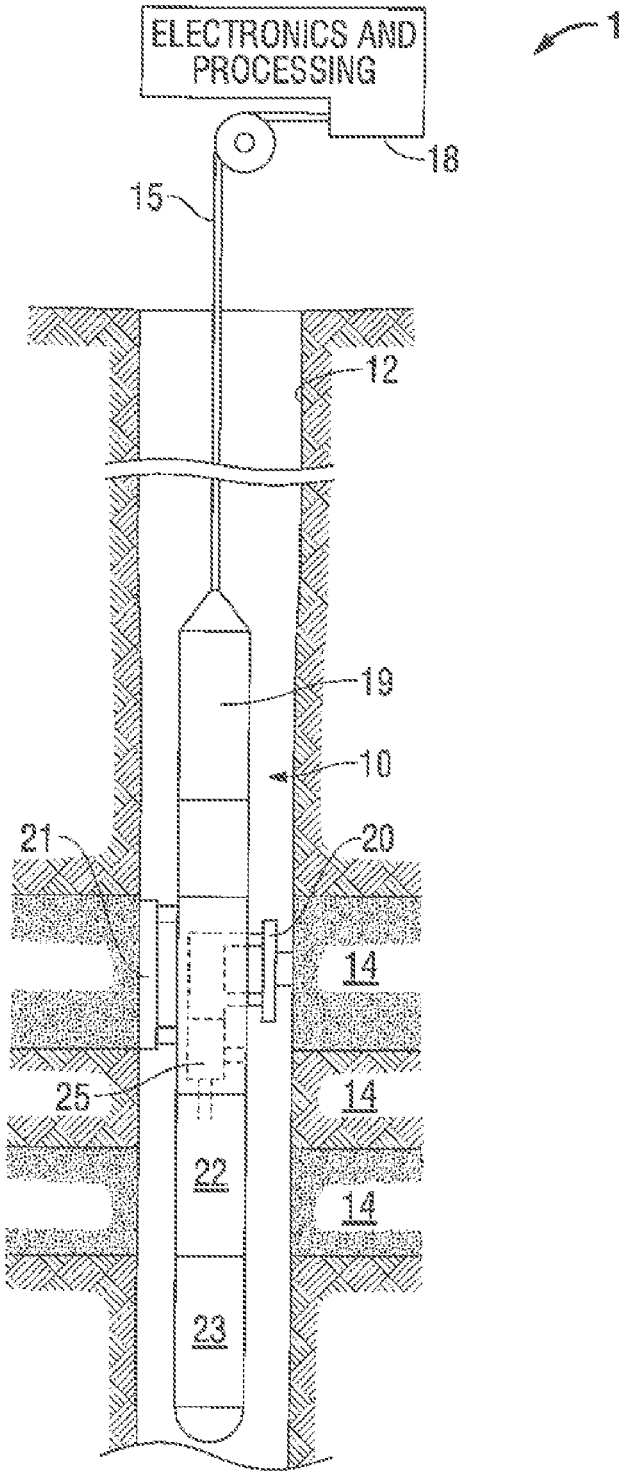
FIG. 1A (Prior Art)
FIG. 1A is a schematic diagram of an exemplary petroleum reservoir analysis system in which the present invention is embodied.

FIG. 1A illustrates an exemplary petroleum reservoir analysis system 1 in which the present invention is embodied. The system 1 includes a borehole tool 10 suspended in the borehole 12 from the lower end of a typical multiconductor cable 15 that is spooled in a usual fashion on a suitable winch on the earth's surface. The cable 15 is electrically coupled to an electrical control system 18 on the formation surface. The tool 10 includes an elongated body 19 which carries a selectively extendable fluid admitting assembly 20 and a selectively extendable tool anchoring member 21 which are respectively arranged on opposite sides of the tool body 19. The fluid admitting assembly 20 is equipped for selectively sealing off or isolating selected portions of the wall of the borehole 12 such that fluid communication with the adjacent earth formation 14 is established. The fluid admitting assembly 20 and tool 10 include a flowline leading to a fluid analysis module 25. The formation fluid obtained by the fluid admitting assembly 20 flows through the flowline and through the fluid analysis module 25. The fluid may thereafter be expelled through a port or it may be sent to one or more fluid collecting chambers 22 and 23 which may receive and retain the fluids obtained from the formation 14. With the assembly 20 sealingly engaging the formation 14, a short rapid pressure drop can be used to break the mudcake seal. Normally, the first fluid drawn into the tool 10 will be highly contaminated with mud filtrate. As the tool 10 continues to draw fluid from the formation 14, the area near the fluid admitting assembly 20 cleans up and reservoir fluid becomes the dominant constituent. The time required for cleanup depends upon many parameters, including formation permeability, fluid viscosity, the pressure differences between the borehole and the formation, and overbalanced pressure difference and its duration during drilling. Increasing the pump rate can shorten the cleanup time, but the rate must be controlled carefully to preserve formation pressure conditions.

The fluid analysis module 25 includes means for measuring the temperature and pressure of the fluid in the flowline. The fluid analysis module 25 derives properties that characterize the formation fluid sample at the flowline pressure and temperature. In one embodiment, the fluid analysis module 25 measures absorption spectra and translates such measurements into concentrations of several alkane components and groups in the fluid sample. In an illustrative embodiment, the fluid analysis module 25 provides measurements of the concentrations (e.g., weight percentages) of carbon dioxide ($CO_2$), methane ($CH_4$), ethane ($C_2H_6$), the C3-C5 alkane group, the lump of hexane and heavier alkane components (C6+), and asphaltene content. The C3-C5 alkane group includes propane, butane, and pentane. The C6+ alkane group includes hexane ($C_6H_{14}$), heptane ($C_7H_{16}$), octane ($C_8H_{18}$), nonane ($C_9H_{20}$), decane ($C_{10}H_{22}$), hendecane ($C_{11}H_{24}$)—also referred to as endecane or undecane, dodecane ($C_{12}H_{26}$), tridecane ($C_{13}H_{28}$), tetradecane ($C_{14}H_{30}$), pentadecane ($C_{15}H_{32}$), hexadecane ($C_{16}H_{34}$), etc. The fluid analysis module 25 also provides a means that measures live fluid density ($\rho$) at the flowline temperature and pressure, live fluid viscosity ($\mu$) at flowline temperature and pressure (in cp), formation pressure, and formation temperature.

Control of the fluid admitting assembly 20 and fluid analysis module 25, and the flow path to the fluid collecting chambers 22, 23 is maintained by the control system 18. As will be appreciated by those skilled in the art, the fluid analysis module 25 and the surface-located electrical control system 18 include data processing functionality (e.g., one or more microprocessors, associated memory, and other hardware and/or software) to implement the invention as described herein. The electrical control system 18 can also be realized by a distributed data processing system wherein data measured by the tool 10 is communicated (preferably in real time) over a communication link (typically a satellite link) to a remote location for data analysis as described herein. The data analysis can be carried out on a workstation or other suitable data processing system (such as a computer cluster or computing grid).

Formation fluids sampled by the tool 10 may be contaminated with mud filtrate. That is, the formation fluids may be contaminated with the filtrate of a drilling fluid that seeps into the formation 14 during the drilling process. Thus, when fluids are withdrawn from the formation 14 by the fluid admitting assembly 20, they may include mud filtrate. In some examples, formation fluids are withdrawn from the formation 14 and pumped into the borehole or into a large waste chamber in the tool 10 until the fluid being withdrawn becomes sufficiently clean. A clean sample is one where the concentration of mud filtrate in the sample fluid is acceptably low so that the fluid substantially represents native (i.e., naturally occurring) formation fluids. In the illustrated example, the tool 10 is provided with fluid collecting chambers 22 and 23 to store collected fluid samples.

The system of FIG. 1A is adapted to make in situ determinations regarding hydrocarbon bearing geological formations by downhole sampling of reservoir fluid at one or more measurement stations within the borehole 12, conducting downhole fluid analysis of one or more reservoir fluid samples for each measurement station (including compositional analysis such as estimating concentrations of a plurality of compositional components of a given sample as well as other fluid properties), and relating the downhole fluid analysis to an equation of state (EOS) model of the thermodynamic behavior of the fluid in order to characterize the reservoir fluid at different locations within the reservoir. With the reservoir fluid characterized with respect to its thermodynamic behavior, fluid production parameters, transport properties, and other commercially useful indicators of the reservoir can be computed.

For example, the EOS model can provide the phase envelope that can be used to interactively vary the rate at which samples are collected in order to avoid entering the two-phase region. In another example, the EOS can provide properties useful in assessing production methodologies for the particular reserve. Such properties can include density, viscosity, and volume of gas formed from a liquid after expansion to a specified temperature and pressure. The characterization of the fluid sample with respect to its thermodynamic model can also be used as a benchmark to determine the validity of the obtained sample, whether to retain the sample, and/or whether to obtain another sample at the location of interest. More particularly, based on the thermodynamic model and information regarding formation pressures, sampling pressures, and formation temperatures, if it is determined that the fluid sample was obtained near or below the bubble line of the sample, a decision may be made to jettison the sample and/or to obtain a sample at a slower rate (i.e., a smaller pressure drop) so that gas will not evolve out of the sample. Alternatively, because knowledge of the exact dew point of a retrograde gas condensate in a formation is desirable, a decision may be made, when conditions allow, to vary the pressure drawdown in an attempt to observe the liquid condensation and thus establish the actual saturation pressure.

Figure 1B:
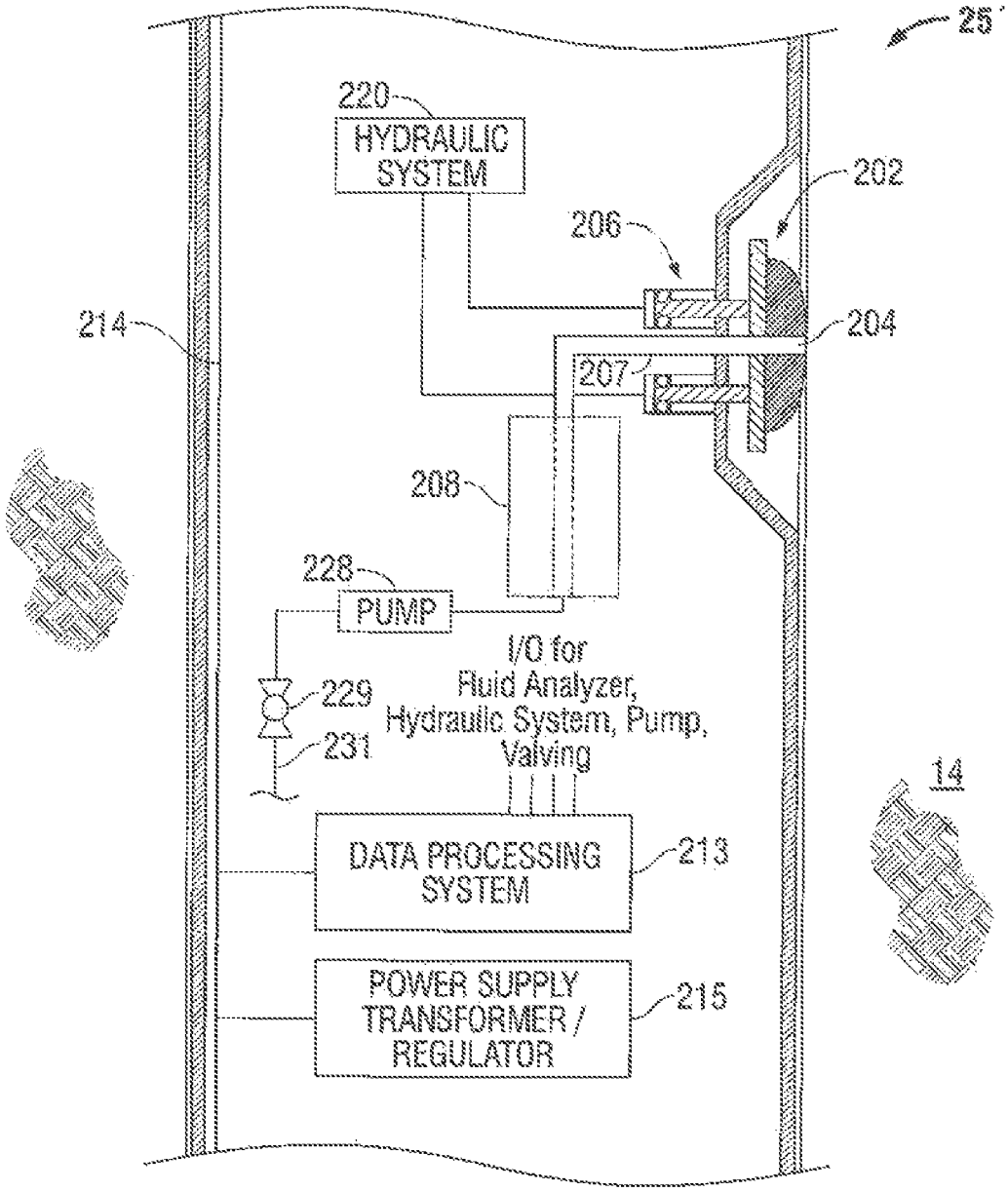
FIG. 1B (Prior Art)
FIG. 1B is a schematic diagram of an exemplary fluid analysis module suitable for use in the borehole tool of FIG. 1A.

FIG. 1B illustrates an exemplary embodiment of the fluid analysis module 25 of FIG. 1A (labeled 25'), including a probe 202 having a port 204 to admit formation fluid therein. A hydraulic extending mechanism 206 may be driven by a hydraulic system 220 to extend the probe 202 to sealingly engage the formation 14 (FIG. 1A). In alternative implementations, more than one probe can be used or inflatable packers can replace the probe(s) and function to establish fluid connections with the formation and sample fluid samples.

The probe 202 can be realized by the Quicksilver Probe offered commercially by Schlumberger Technology Corporation of Sugar Land, Tex., USA. The Quicksilver Probe divides the fluid flow from the reservoir into two concentric zones, a central zone isolated from a guard zone about the perimeter of the central zone. The two zones are connected to separate flowlines with independent pumps. The pumps can be run at different rates to exploit filtrate/fluid viscosity contrast and permeability anistrotropy of the reservoir. Higher intake velocity in the guard zone directs contaminated fluid into the guard zone flowline, while clean fluid is drawn into the central zone. Fluid analyzers analyze the fluid in each flowline to determine the composition of the fluid in the respective flowlines. The pump rates can be adjusted based on such compositional analysis to achieve and maintain desired fluid contamination levels. The operation of the Quicksilver Probe efficiently separates contaminated fluid from cleaner fluid early in the fluid extraction process, which results in obtaining clean fluid in much less time compared to traditional formation testing tools.

The fluid analysis module 25' includes a flowline 207 that carries formation fluid from the port 204 through a fluid analyzer 208. The fluid analyzer 208 includes a light source that directs light to a sapphire prism disposed adjacent the flowline fluid flow. The reflection of such light is analyzed by a gas refractometer and dual fluoroscene detectors. The gas refractometer qualitatively identifies the fluid phase in the flowline. At the selected angle of incidence of the light emitted from the diode, the reflection coefficient is much larger when gas is in contact with the window than when oil or water is in contact with the window. The dual fluoroscene detectors detect free gas bubbles and retrograde liquid dropout to accurately detect single-phase fluid flow in the flowline 207. Fluid type is also identified. The resulting phase information can be used to define the difference between retrograde condensates and volatile oils, which can have similar GORs and live-oil densities. It can also be used to monitor phase separation in real time and ensure single-phase sampling. The fluid analyzer 208 also includes dual spectrometers—a filter-array spectrometer and a grating-type spectrometer.

The filter-array spectrometer of the fluid analyzer 208 includes a broadband light source providing broadband light that passes along optical guides and through an optical chamber in the flowline to an array of optical density detectors that are designed to detect narrow frequency bands (commonly referred to as channels) in the visible and near-infrared spectra as described in U.S. Pat. No. 4,994,671, incorporated herein by reference. Preferably, these channels include a subset of channels that detect water absorption peaks (which are used to characterize water content in the fluid) as well as a dedicated channel corresponding to the absorption peak of $CO_2$ with dual channels above and below this dedicated channel that subtract out the overlapping spectrum of hydrocarbon and small amounts of water (which are used to characterize $CO_2$ content in the fluid). The filter-array spectrometer also employs optical filters that provide for identification of the color (also referred to as "optical density" or "OD") of the fluid in the flowline. Such color measurement supports fluid identification, determination of asphaltene content and pH measurement. Mud filtrates or other solid materials generate noise in the channels of the filter-array spectrometer. Scattering caused by these particles is independent of wavelength. In the preferred embodiment, the effect of such scattering can be removed by subtracting a nearby channel.

The grating-type spectrometer of the fluid analyzer 208 is designed to detect channels in the near-infrared spectrum (preferably between 1600-1800 nm) where reservoir fluid has absorption characteristics that reflect molecular structure.

The fluid analyzer 208 also includes a pressure sensor for measuring pressure of the formation fluid in the flowline 207, a temperature sensor for measuring temperature of the formation fluid in the flowline 207, and a density sensor for measuring live fluid density of the fluid in the flowline 207. In the preferred embodiment, the density sensor is realized by a vibrating sensor that oscillates in two perpendicular modes within the fluid. Simple physical models describe the resonance frequency and quality factor of the sensor in relation to live fluid density. Dual-mode oscillation is advantageous over other resonant techniques because it minimizes the effects of pressure and temperature on the sensor through common mode rejection. In addition to density, the density sensor can also provide a measurement of live fluid viscosity from the quality factor of oscillation frequency. Note that live fluid viscosity can also be measured by placing a vibrating object in the fluid flow and measuring the increase in line width of any fundamental resonance. This increase in line width is related closely to the viscosity of the fluid. The change in frequency of the vibrating object is closely associated with the mass density of the object. If density is measured independently, then the determination of viscosity is more accurate because the effects of a density change on the mechanical resonances are determined. Generally, the response of the vibrating object is calibrated against known standards. The fluid analyzer 208 can also measure the resistivity and pH of fluid in the flowline 207. In the preferred embodiment, the fluid analyzer 208 is realized by the InSitu Fluid Analyzer commercially available from Schlumberger Technology Corporation. In other exemplary implementations, the flowline sensors of the fluid analyzer 208 may be replaced or supplemented with other types of suitable measurement sensors (e.g., NMR sensors, capacitance sensors, etc.). Pressure sensor(s) and/or temperature sensor(s) for measuring pressure and temperature of fluid drawn into the flowline 207 can also be part of the probe 202.

A pump 228 is fluidly coupled to the flowline 207 and is controlled to draw formation fluid into the flowline 207 and possibly to supply formation fluid to the fluid collecting chambers 22 and 23 (FIG. 1A) via valve 229 and flowpath 231 (FIG. 1B).

The fluid analysis module 25' includes a data processing system 213 that receives and transmits control and data signals to the other components of the module 25' for controlling operations of the module 25'. The data processing system 213 also interfaces to the fluid analyzer 208 for receiving, storing, and processing the measurement data generated therein. In the preferred embodiment, the data processing system 213 processes the measurement data output by the fluid analyzer 208 to derive and store measurements of the hydrocarbon composition of fluid samples analyzed insitu by the fluid analyzer 208, including flowline temperature;

flowline pressure;

live fluid density (ρ) at the flowline temperature and pressure;

live fluid viscosity (μ) at flowline temperature and pressure;

concentrations (e.g., weight percentages) of carbon dioxide ($CO_2$), methane ($CH_4$), ethane ($C_2H_6$), the C3-C5 alkane group, the lump of hexane and heavier alkane components (C6+), and asphaltene content;

GOR; and possibly other parameters (such as API gravity, oil formation volume factor (Bo), etc.).

Flowline temperature and pressure is measured by the temperature sensor and pressure sensor, respectively, of the fluid analyzer 208 (and/or probe 202). In the preferred embodiment, the outputs of the temperature sensor(s) and pressure sensor(s) are monitored continuously before, during, and after sample acquisition to derive the temperature and pressure of the fluid in the flowline 207. The formation temperature is not likely to deviate substantially from the flowline temperature at a given measurement station and thus can be estimated as the flowline temperature at the given measurement station in many applications. Formation pressure can be measured by the pressure sensor of the fluid analyzer 208 in conjunction with the downhole fluid sampling and analysis at a particular measurement station after buildup of the flowline to formation pressure.

Live fluid density (ρ) at the flowline temperature and pressure is determined by the output of the density sensor of the fluid analyzer 208 at the time the flowline temperature and pressure is measured.

Live fluid viscosity (μ) at flowline temperature and pressure is derived from the quality factor of the density sensor measurements at the time the flowline temperature and pressure is measured.

The measurements of the hydrocarbon composition of fluid samples are derived by translation of the data output by spectrometers of the fluid analyzer 208.

The GOR is determined by measuring the quantity of methane and liquid components of crude oil using near infrared absorption peaks. The ratio of the methane peak to the oil peak on a single phase live crude oil is directly related to GOR.

The fluid analysis module 25' can also detect and/or measure other fluid properties of a given live oil sample, including retrograde dew formation, asphaltene precipitation and/or gas evolution.

The fluid analysis module 25' also includes a tool bus 214 that communicates data signals and control signals between the data processing system 213 and the surface-located electrical control system 18 of FIG. 1A. The tool bus 214 can also carry electrical power supply signals generated by a surface-located power source for supply to the fluid analysis module 25', and the fluid analysis module 25' can include a power supply transformer/regulator 215 for transforming the electric power supply signals supplied via the tool bus 214 to appropriate levels suitable for use by the electrical components of the fluid analysis module 25'.

Although the components of FIG. 1B are shown and described above as being communicatively coupled and arranged in a particular configuration, persons of ordinary skill in the art will appreciate that the components of the fluid analysis module 25' can be communicatively coupled and/or arranged differently than depicted in FIG. 1B without departing from the scope of the present disclosure. In addition, the example methods, apparatus, and systems described herein are not limited to a particular conveyance type but, instead, may be implemented in connection with different conveyance types including, for example, coiled tubing, wireline, wired drill pipe, and/or other conveyance means known in the industry.

Figure 2A:
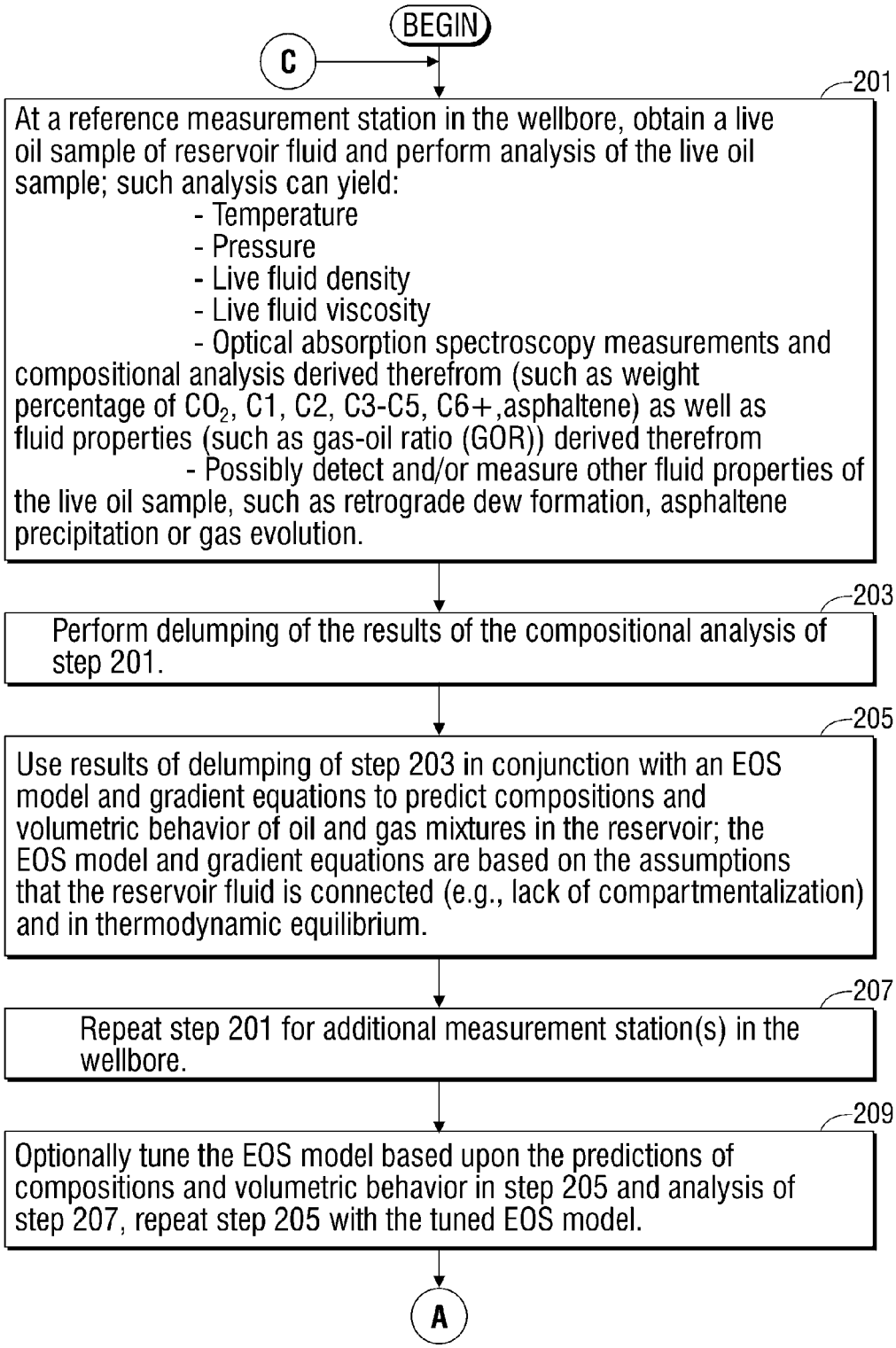
FIGS. 2A-2C, collectively, are a flow chart of data analysis operations that includes downhole fluid measurements at a number of different measurement stations within a wellbore traversing a reservoir or interest in conjunction with at least one model that characterizes the relationship between a particular fluid property and asphaltene content at different measurement stations. The model is used to calculate a predicted value of the particular fluid property for at least one given measurement station. A consistency check is performed that involves comparison of the predicted value of the particular fluid property for the at least one given measurement station with the corresponding fluid property measured by the downhole fluid analysis for the at least one given measurement station. The results of the consistency check are used for reservoir analysis.
Figure 2B:
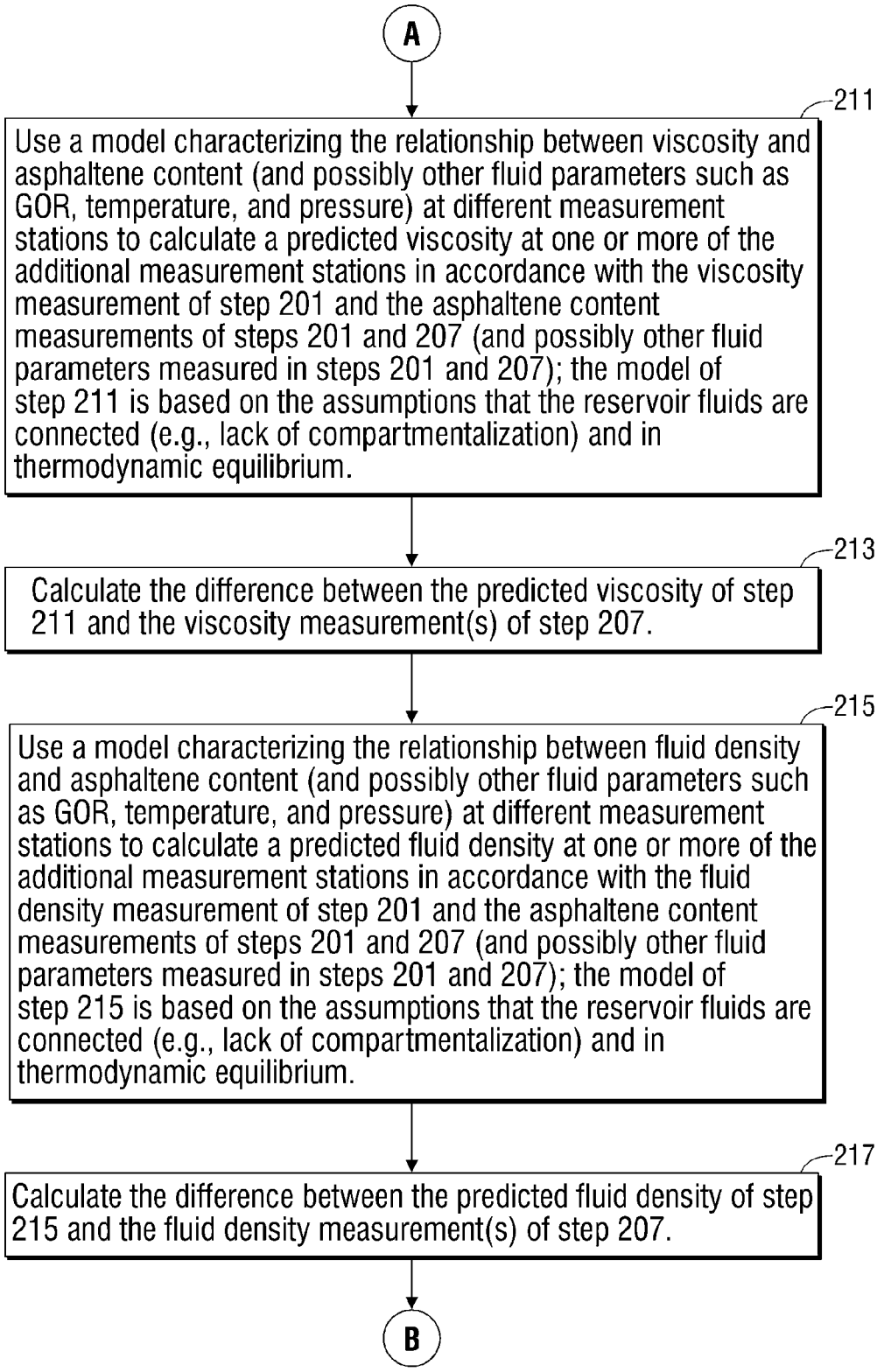
Figure 2C:
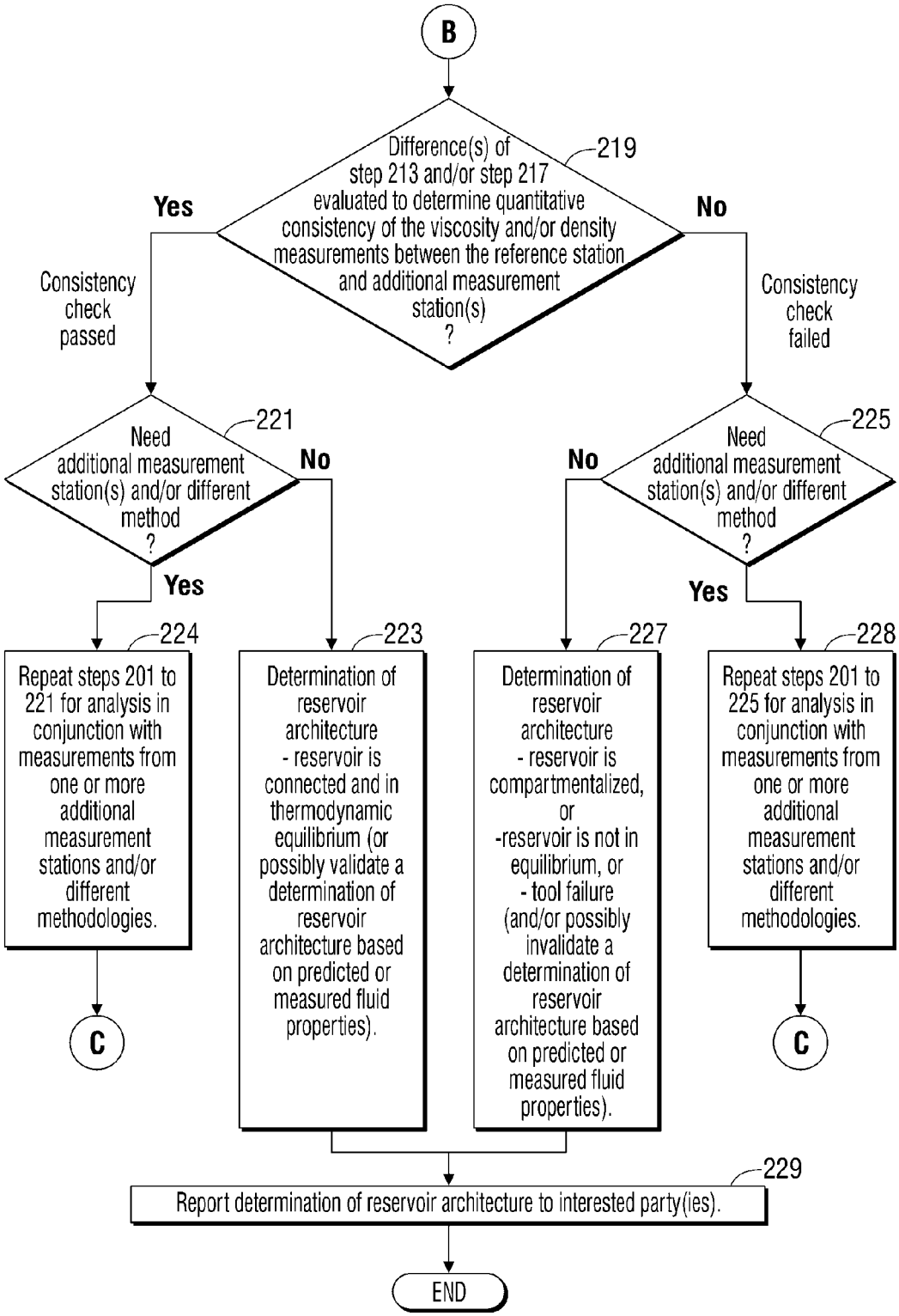

In accordance with the present invention, the system of FIGS. 1A and 1B can be employed with the methodology of FIGS. 2A-2C to characterize the fluid properties of a petroleum reservoir of interest based upon downhole fluid analysis of samples of reservoir fluid. As will be appreciated by those skilled in the art, the surface-located electrical control system 18 and the fluid analysis module 25 of the tool 10 each include data processing functionality (e.g., one or more microprocessors, associated memory, and other hardware and/or software) that cooperate to implement the invention as described herein. The electrical control system 18 can also be realized by a distributed data processing system wherein data measured by the tool 10 is communicated in real time over a communication link (typically a satellite link) to a remote location for data analysis as described herein. The data analysis can be carried out on a workstation or other suitable data processing system (such as a computer cluster or computing grid).

The operations begin in step 201 by employing the downhole fluid analysis (DFA) tool of FIGS. 1A and 1B to obtain a sample of the formation fluid at the reservoir pressure and temperature (a live oil sample) at a measurement station in the wellbore (for example, a reference station). The sample is processed by the fluid analysis module 25. In the preferred embodiment, the fluid analysis module 25 performs spectrophotometry measurements that measure absorption spectra of the sample and translates such spectrophotometry measurements into concentrations of several alkane components and groups in the fluids of interest. In an illustrative embodiment, the fluid analysis module 25 provides measurements of the concentrations (e.g., weight percentages) of carbon dioxide ($CO_2$), methane ($CH_4$), ethane ($C_2H_6$), the C3-C5 alkane group including propane, butane, and pentane, the lump of hexane and heavier alkane components (C6+), and asphaltene content. The tool 10 also preferably provides a means to measure temperature of the fluid sample (and thus reservoir temperature at the station), pressure of the fluid sample (and thus reservoir pressure at the station), live fluid density of the fluid sample, live fluid viscosity of the fluid sample, gas-oil ratio (GOR) of the fluid sample, optical density, and possibly other fluid parameters (such as API gravity, formation volume fraction (FVF), etc.) of the fluid sample.

In step 203, a delumping process is carried out to characterize the compositional components of the sample analyzed in step 201. The delumping process splits the concentration (e.g., weight fraction) of given compositional lumps (C3-C5, C6+) into concentrations (e.g., weight fractions) for single carbon components of the given compositional lump (e.g., split C3-C5 lump into C3, C4, C5, and split C6+ lump into C6, C7, C8 . . . ). The exemplary delumping operations carried out as part of step 203 are described in detail in US Patent Application Publication No. 2009/0192768, incorporated herein by reference.

In step 205, the results of the delumping process of step 203 are used in conjunction with an equation of state (EOS) model to predict compositions and fluid properties (such as volumetric behavior of oil and gas mixtures) in the reservoir.

The EOS model of step 205 includes a set of equations that represent the phase behavior of the compositional components of the reservoir fluid. Such equations can take many forms. For example, they can be any one of many cubic EOS, as is well known. Such cubic EOS include van der Waals EOS (1873), Redlich-Kwong EOS (1949), Soave-Redlich Kwong EOS (1972), Peng-Robinson EOS (1976), Stryjek-Vera-Peng-Robinson EOS (1986) and Patel-Teja EOS (1982). Volume shift parameters can be employed as part of the cubic EOS in order to improve liquid density predictions as is well known. Mixing rules (such as van der Waals mixing rule) can also be employed as part of the cubic EOS. A SAFT-type EOS can also be used as is well known in the art.

In the preferred embodiment, the EOS model of step 205 predicts compositional gradients with depth that take into account the impacts of gravitational forces, chemical forces, thermal diffusion, etc. To calculate compositional gradients with depth in a hydrocarbon reservoir, it is usually assumed that the reservoir fluids are connected (i.e., there is a lack of compartmentalization) and in thermodynamic equilibrium. Moreover, it is assumed that there are no adsorption phenomena or any kind of chemical reactions in the reservoir. The mass flux (J) of compositional component i that crosses the boundary of an elementary volume of the porous media is expressed as:

$$J_i = \rho_i\left(\sum_{j=1}^{n}(L_{ij}\nabla_T g_j^t) + L_{ip}(\rho g - \nabla P) + L_{iq}\nabla T\right) \tag{1}$$

where $L_{ij}$, $L_{ip}$, and $L_{iq}$ are the phenomenological coefficients, $\rho_i$ denotes the partial density of component i, ρ, g, P, T are the density, the acceleration, pressure, and temperature, respectively, and $g_j^t$ is the contribution of component j to mass free energy of the fluid in a porous media, which can be divided into a chemical potential part $\mu_i$ and a gravitational part gz (where z is the vertical depth).

The average fluid velocity (u) is estimated by:

$$u = \frac{\sum_{j=1}^{n} J_j}{\rho}. \tag{2}$$

According to Darcy's law, the phenomenological baro-diffusion coefficients must meet the following constraint:

$$\frac{k}{\eta} = \frac{\sum_{j=1}^{n}\rho_j L_{jp}}{\rho} \tag{3}$$

where k and η are the permeability and the viscosity, respectively.

If the pore size is far above the mean free path of molecules, the mobility of the components, due to an external pressure field, is very close to the overall mobility. The mass chemical potential is a function of mole fraction (x), pressure, and temperature.

At constant temperature, the derivative of the mass chemical potential (t) has two contributions:

$$\nabla_T \mu_j = \sum_{k=1}^{n}\left(\frac{\partial \mu_j}{\partial x_k}\right)_{T,P,x_{i\neq k}}\nabla x_k + \left(\frac{\partial \mu_j}{\partial P}\right)_{T,x}\nabla P \tag{4}$$

where the partial derivatives can be expressed in terms of EOS (fugacity coefficients):

$$\left(\frac{\partial \mu_j}{\partial x_k}\right)_{T,P,x_{j\neq k}} = \frac{RT}{M_j}\left(\frac{\partial \ln f_j}{\partial x_k}\right)_{T,P,x_{j\neq k}} = \frac{RT}{M_j}\left(\frac{\delta_{jk}}{x_k} + \frac{1}{\varphi_j}\left(\frac{\partial \varphi_j}{\partial x_k}\right)_{T,P,x_{j\neq k}}\right) \tag{5}$$

$$\left(\frac{\partial \mu_j}{\partial P}\right)_{T,x} = \frac{\bar{v}_j}{M_j} = \frac{RT}{M_j}\left(\frac{1}{P} + \left(\frac{\partial \varphi_j}{\partial P}\right)_{T,x}\right) \tag{6}$$

where $M_j$, $f_j$, $\phi_j$, and $v_j$ are the molecular weight, fugacity, fugacity coefficient, and partial molar volume of component j, respectively;

$x_k$ is the mole fraction of component k;

R denotes the universal gas constant; and

δ is the Kronecker delta function.

In the ideal case, the phenomenological coefficients (L) can be related to effective practical diffusion coefficients ($D_i^{eff}$):

$$L_{ii} = -\frac{M_i}{RT}D_i^{eff}. \tag{7}$$

The mass conservation for component i in an n-component reservoir fluid, which governs the distribution of the components in the porous media, is expressed as:

$$\frac{\partial \rho_i}{\partial t} + \nabla J_i = 0,\ i = 1, 2, \ldots, n. \tag{8}$$

The equation can be used to solve a wide range of problems. This is a dynamic model which is changing with time t.

Let us consider that the mechanical equilibrium of the fluid column has been achieved:

$$\nabla_z P = \rho g. \tag{9}$$

The vertical distribution of the components can be calculated by solving the following set of equations:

$$\frac{\partial \ln f_i}{\partial z} - \frac{M_i g}{RT} + \frac{J_{i,z}}{x_i D_i^{eff}}\frac{M}{\rho M_i} - \frac{L_{iq}}{D_i^{eff}}\frac{\partial T}{\partial z} = 0,\ i = 1, 2, \ldots, n \tag{10}$$

and $$\sum_{k=1}^{n}\left(\frac{\delta_{ik}}{x_k} + \frac{1}{\varphi_i}\frac{\partial \varphi_i}{\partial x_k}\right)\nabla_z x_k + \frac{(v_i\rho - M_i)g}{RT} + \frac{J_{i,z}}{x_i D_i^{eff}}\frac{M}{\rho M_i} - \frac{L_{iq}}{D_i^{eff}}\frac{\partial T}{\partial z} = 0 \tag{11}$$

where $J_{i,z}$ is the vertical component of the external mass flux. This formulation allows computation of the stationary state of the fluid column and it does not require modeling of the dynamic process leading to the observed compositional distribution.

If the horizontal components of external fluxes are significant, the equations along the other axis have to be solved as well. Along a horizontal "x" axis the equations become:

$$\frac{\partial \ln f_i}{\partial x} + \frac{J_{i,x}}{x_i D_i^{eff}} \frac{M}{\rho M_i} - \frac{L_{iq}}{D_i^{eff}} \frac{\partial T}{\partial x} = 0. \tag{12}$$

The mechanical equilibrium of the fluid column $\nabla_z P = \rho g$, is a particular situation which will occur only in highly permeable reservoirs. In the general case, the vertical pressure gradient is calculated by:

$$\nabla_z P = \rho g - \frac{\nabla_z P_{Fluxes} + \nabla_z P_{Soret}}{1 + R_p} \tag{13}$$

where $R_p$ is calculated by $$R_p = RT \frac{k}{\eta} \frac{\rho}{M} \sum_{i=1}^{n} \frac{x_i}{D_i^{eff}}. \tag{14}$$

The pressure gradient contribution from thermal diffusion (so-called Soret contribution) is given by:

$$\nabla_z P_{Soret} = RT \frac{\rho}{M} \sum_{i=1}^{n} x_i \frac{L_{iq}}{D_i^{eff}} \nabla_z T. \tag{15}$$

And the pressure gradient contribution from external fluxes is expressed as $$\nabla_z P_{Fluxes} = RT \sum_{i=1}^{n} \frac{J_{i,z}}{M_i D_i^{eff}}. \tag{16}$$

Assuming an isothermal reservoir and ignoring the external flux, results in the following equation:

$$\frac{\partial \ln f_i}{\partial z} - \frac{M_i g}{RT} = 0, \quad i = 1, 2, \ldots, n. \tag{17}$$

Equation (17) can be rewritten as $$\frac{\partial \ln f_i}{\partial z} - \frac{M_i g}{RT} + a_i = 0, \quad i = 1, 2, \ldots, n \tag{18}$$

where $a_i$ is computed by:

$$a_i = \frac{J_{i,z}}{x_i D_i^{eff}} \frac{M}{\rho M_i} - \frac{L_{iq}}{D_i^{eff}} \frac{\partial T}{\partial z}, \quad i = 1, 2, \ldots, n. \tag{19}$$

Other suitable EOS models can also be used to predict compositions and volumetric behavior of oil and gas mixtures in the reservoir.

In addition to these general equations, the variation of asphaltene content with depth can be accounted for by a multicomponent Flory-Huggins regular solution model combined with a gravitational contribution. More specifically, the reservoir fluid can be treated as a mixture of two components: a solvent group (non-asphaltene components or maltene) and a solute group (asphaltene). The solvent group is a mixture whose properties are measured by downhole fluid analysis and/or estimated by the EOS model. The concentration (volume fraction) of the asphaltene component as a function of depth can be represented as:

$$\frac{\phi_a(h_2)}{\phi_a(h_1)} = \exp\left\{\left[\left(\frac{v_a}{v_m} - 1\right)\right]_{h_2} - \left[\left(\frac{v_a}{v_m} - 1\right)\right]_{h_1}\right\} \exp\left\{\left[\left(\frac{v_a}{RT}(\delta_a - \delta_m)^2\right]_{h_2} - \left[\left(\frac{v_a}{RT}(\delta_a - \delta_m)^2\right]_{h_1}\right\} \exp\left\{\frac{v_a g(\rho_m - \rho_a)(h_2 - h_1)}{RT}\right\} \tag{20}$$

where $\phi_a(h_1)$ is the volume fraction for asphaltene component at depth $h_1$, $\phi_a(h_2)$ is the volume fraction for asphaltene component at depth $h_2$, $v_a$ is the molar volume for the asphaltene component, $v_m$ is the molar volume for the maltene component, $\delta_a$ is the solubility parameter for the asphaltene component, $\delta_m$ is the solubility parameter for the maltene component, $\rho_a$ is the density for the asphaltene component, $\rho_m$ is the density for the maltene component, R is the universal gas constant, and T is the absolute temperature of the reservoir fluid.

The first exponential term of equation (20) arises from the combinatorial entropy change of mixing. The second exponential term of equation (20) arises from the enthalpy change of mixing. The third term arises from gravitational contributions. It can be assumed that the reservoir fluid is isothermal. In this case, the temperature T can be set to the average formation temperature as determined from downhole fluid analysis. Alternatively, a temperature gradient with depth (preferably a linear temperature distribution) can be derived from downhole fluid analysis and the temperature T at a particular depth determined from such temperature gradient.

The density of the maltene component $\rho_m$ at a given depth can be derived from the densities of the components of the maltene at the given depth by:

$$\rho_m = \sum_i \rho_i \phi_i \tag{21}$$

where $\phi_i$ is the volume fraction of the component i of the maltene at the given depth, and $\rho_i$ is the density for the component i of the maltene at the given depth.

The volume fractions $\phi_i$ for the maltene components at the given depth can be measured, estimated from measured mass or mole fractions, estimated from the solution of the compositional gradients produced by the EOS model (equations (17) or (18)), or other suitable approach. The density $\rho_i$ for the maltene components at the given depth can be known, estimated from the solution of the compositional gradients produced by the EOS model (equations (17) or (18)), or other suitable approach.

The molar volume $v_m$ for the maltene at a given depth can be derived by:

$$v_m = \frac{\sum_i x_i M_i}{\rho_m} \tag{22}$$

where $x_i$ is the mole fraction of component i of the maltene,
$M_i$ is the molar mass of component i of the maltene, and
$\rho_m$ is the density of the maltene.

The mole fractions $x_i$ for the maltene components at the given depth can be measured, estimated from measured mass or mole fractions, estimated from the solution of the compositional gradients produced by the EOS model (equations (17) or (18)), or other suitable approach. The molar mass $M_i$ for the maltene components are known. The density $\rho_m$ for the maltene at the given depth is provided by the solution of equation (21).

The solubility parameter $\delta_m$ for the maltene at a given depth can be derived as the average of the solubility parameter for the components of the maltene at the given depth, given by:

$$\delta_m = \left(\sum_i \phi_i \delta_i\right) / \sum_i \phi_i \tag{23}$$

where $\phi_i$ is the volume fraction of the component i of the maltene at the given depth, and
$\delta_i$ is the solubility parameter for the component i of the maltene at the given depth.

The volume fractions $\phi_i$ for the maltene components at the given depth can be measured, estimated from measured mass or mole fractions, estimated from the solution of the compositional gradients produced by the EOS model (equations (17) or (18)), or other suitable approach. The solubility parameters $\delta_i$ for the maltene components at the given depth can be known, or estimated from measured mass or mole fractions, estimated from the solution of the compositional gradients produced by the EOS model (equations (17) or (18)), or other suitable approach.

It is also contemplated that the solubility parameter $\delta_m$ for the maltene at a given depth can be derived from an empirical correlation to the density of the maltene component $\rho_m$ at a given depth. For example, the solubility parameter $\delta_m$ (in $(MPa)^{0.5}$) can be derived from:

$$\delta_m = D\rho_m + C \tag{24}$$

where $D=(0.004878R_s+9.10199)$,
$C=(8.3271\rho-0.004878R_s\rho+2.904)$,
$R_s$ is the GOR at the given depth in scf/stb, and
$\rho$ is the bulk live oil density at the given depth in $g/cm^3$.

The GOR ($R_s$) as a function of depth in the oil column can be measured by downhole fluid analysis or derived from the predictions of compositional components of the reservoir fluid as a function of depth as described below. The bulk live oil density ($\rho$) as a function of depth can be measured by downhole fluid analysis or derived from the predictions of compositional components of the reservoir fluid as a function of depth. In another example, the solubility parameter $\delta_m$ (in $(MPa)^{0.5}$) can be derived from a simple correlation to the density of the maltene component $\rho_m$ at a given depth, given by:

$$\delta_m = 17.347\rho_m + 2.904. \tag{25}$$

With the molar volume, solubility parameter, and density of the maltene known, the density of the asphaltene component $\rho_a$ can be assumed to be on the order of 1.1 to 1.2 g/cc. This allows equation (20) to be solved as a function of two parameters, the molar volume and solubility of the asphaltene component as a function of depth. In this manner, equation (20) determines a family of curves for the asphaltene concentration as a function of depth. The solution can be solved by fitting equation (20) to empirical data to determine the molar volume and solubility of the asphaltene component of the asphaltene as function of depth. If no fit is possible, then the asphaltene might not be in equilibrium or a more complex formulism may be required to describe the oil in the column.

It is also possible that equation (20) can be simplified by ignoring the first and second exponent terms, which gives:

$$\frac{\phi_a(h_2)}{\phi_a(h_1)} = \exp\left\{\frac{v_{ai} g(\rho_m - \rho_{ai})(h_2 - h_1)}{RT}\right\}. \tag{26}$$

This equation (26) can be solved in a manner similar to that described above for equation (20) in order to derive the concentration of asphaltene as a function of depth (h) in the oil column.

It is also contemplated that asphaltene concentration as a function of depth in the oil column can be derived from flash calculations that solve for fugacities of components (including the asphaltene component) that form at equilibrium. Details of suitable flash calculations are described by Li in "Rapid Flash Calculations for Compositional Simulation," SPE Reservoir Evaluation and Engineering, October 2006, incorporated herein by reference. The flash equations are based on a fluid phase equilibria model that finds the number of phases, and the distribution of species among the phases, that minimizes Gibbs Free Energy. More specifically, the flash calculations calculate the equilibrium phase conditions of a mixture as a function of pressure, temperature, and composition. The fugacities of the components derived from such flash calculations can be used to derive the asphaltene content as a function of depth employing the equilibrium equations described in US Patent Application Publication No. 2009/0235731, incorporated herein by reference.

It is also contemplated that asphaltene content (volume fraction) can be related to optical density (OD) measured by downhole fluid analysis by the expression:

$$\frac{OD(h_2)}{OD(h_1)} = C1\frac{\phi_a(h_2)}{\phi_a(h_1)} + C2. \tag{27}$$

This relation provides a correlation between the optical density measurements provided by downhole fluid analysis and asphaltene content as a function of depth. It can also be used to check the consistency of the estimates of asphaltene content as a function of depth derived from the solubility model as described above.

GOR as a function of depth in the oil column can be derived from the predictions of compositional components of the reservoir fluid as a function of depth. More specifically, the solution of the EOS model (equations (17) or (18)) predicts variations of temperature, pressure, and compositional components as a function of depth. GOR (as well as other fluid properties such as API gravity) as a function of depth can be obtained from flash calculations utilizing the compositional components, temperature and pressure at a given depth as predicted by the EOS model.

In step 207, the DFA tool 10 of FIGS. 1A and 1B is used to obtain a sample of the formation fluid at the reservoir pressure and temperature (a live oil sample) at another measurement station in the wellbore, and the downhole fluid analysis as described above with respect to step 201 is performed on this sample. In an illustrative embodiment, the fluid analysis module 25 provides measurements of the concentrations (e.g., weight percentages) of carbon dioxide ($CO_2$), methane ($CH_4$), ethane ($C_2H_6$), the C3-C5 alkane group including propane, butane, pentane, the lump of hexane and heavier alkane components (C6+), and asphaltene content. The tool 10 also preferably provides a means to measure temperature of the fluid sample (and thus reservoir temperature at the station), pressure of the fluid sample (and thus reservoir pressure at the station), live fluid density of the fluid sample, live fluid viscosity of the fluid sample, gas-oil ratio (GOR) of the fluid sample, optical density, and possibly other fluid parameters (such as API gravity, formation volume fraction (FVF), etc.) of the fluid sample.

Optionally, in step 209 the EOS model of step 205 can be tuned based on a comparison of the compositional and fluid property analysis of the DFA tool 10 in step 207 and the compositional and fluid property predictions derived by the EOS model of step 205. Such tuning typically involves selecting parameters of the EOS model in order to improve the accuracy of the predictions generated by the EOS model. EOS model parameters that can be tuned include critical pressure, critical temperature, and acentric factor for single carbon components, binary interaction coefficients, and volume translation parameters. An example of EOS model tuning is described in Reyadh A. Almehaideb et al., "EOS tuning to model full field crude oil properties using multiple well fluid PVT analysis," Journal of Petroleum Science and Engineering, Volume 26, Issues 1-4, pgs. 291-300, 2000, incorporated herein by reference. In the event that the EOS model is tuned, the compositional and fluid property predictions of step 205 can be recalculated from the tuned EOS model.

In step 211, a model that characterizes the relationship between viscosity and asphaltene content (and possibly other fluid parameters such as GOR, temperature, and pressure) at different measurement stations is used to calculate a predicted viscosity for the measurement station(s) of step 207. The predicted viscosity is preferably derived in accordance with the reference viscosity measurement of step 201 and in accordance with the asphaltene content measurements (and possibly other fluid parameters) of steps 201 and 207. The model of step 211 assumes that the reservoir fluids are connected (i.e., there is a lack of compartmentalization) and in thermodynamic equilibrium.

In the illustrative embodiment of the invention, the model of step 211 can be derived from a modified Pal and Rhodes model that provides an explicit relationship between viscosity and asphaltene content for dead oil as follows:

$$\eta=\eta_M[1-K'\cdot A]^{-\nu}. \tag{28}$$

In this equation (28), $\eta$ is the viscosity of the oil, $\eta_M$ is the viscosity of the associated maltene (oil after removal of asphaltenes), and A is the weight fraction of asphaltenes in the oil. The solvation constant, K', and the Pal-Rhodes exponent, $\nu$, are fitting parameters that in principle could vary for different oils; however, values near K'=1.88 and $\nu$=6.9 have been shown to be robust and appropriate for black oils and heavy oil with viscosities in the range $10\text{-}10^8$ cp. This equation (28) is described in M. S. Lin, K. M. Lunsford, C. J. Glover, R. R. Davidson, and J. A. Bullin, "The Effects of Asphaltenes on the Chemical and Physical Characteristics of Asphalt" in *Asphaltenes: Fundamentals and Applications*, Ed. E. Y. Sheu and O. C. Mullins, Plenum Press, New York, 1995.

Equation (28) can be rearranged to show how the viscosity of a live oil sample is related to the viscosity of an oil measured elsewhere in the reservoir (the reference oil sample) as follows:

$$\frac{\eta}{\eta_{ref}}=\left[\frac{1-K'\cdot A}{1-K'\cdot A_0}\right]^{-\nu}. \tag{29}$$

In this equation (29), $\eta$ is the viscosity of the live oil sample, and A is its asphaltene content. $\eta_{ref}$ is the viscosity of the reference oil sample, and $A_0$ is its asphaltene content. This relationship assumes a low/constant GOR and a constant temperature, although the fitting parameters K' and $\nu$ may vary with GOR and reservoir temperature. If these assumptions are not valid, the equation can be corrected using the following equation:

$$\frac{\eta}{\eta_{ref}}=\left(\frac{R_{s0}}{R_s}\right)^{\alpha}\left(\frac{T_0}{T}\right)^{\beta}\exp[\gamma(P-P_0)]. \tag{30}$$

In the preferred embodiment, $\alpha$ is set to (⅓), $\beta$ is set to 4.5, and $\gamma$ is set to $9.6\times10^{-5}$. In equation (30), $R_s$, T, and P are the GOR in scf/stb, temperature in R, and pressure in psia, respectively of the live oil sample, while $R_{s0}$, $T_0$, and $P_0$ are the GOR in scf/stb, temperature in R, and pressure in psia, respectively of the reference oil sample. The exponents and coefficients of equation (30) may vary with oils. Moreover, the exponents and coefficients of equation (30) can be treated as adjustable parameters that can be tuned according to the measurements performed at multiple downhole measurement stations.

Combining equations (29) and (30) provides an exemplary model that characterizes how the viscosity in reservoir fluids varies as a function of asphaltene content (A, $A_0$), GOR ($R_s$, $R_{s0}$), temperature (T, $T_0$), and pressure (P, $P_0$) as follows:

$$\frac{\eta}{\eta_{ref}}=\left[\frac{1-K'\cdot A}{1-K'\cdot A_0}\right]^{-\nu}\left(\frac{R_{s0}}{R_s}\right)^{\alpha}\left(\frac{T_0}{T}\right)^{\beta}\exp[\gamma(P-P_0)]. \tag{31}$$

This model assumes that the reservoir fluids are connected (i.e., there is a lack of compartmentalization) and in thermodynamic equilibrium. In the preferred embodiment, K' is set to 1.88, $\nu$ is set to 6.9, $\alpha$ is set to (⅓), $\beta$ is set to 4.5, and $\gamma$ is set to $9.6\times10^{-5}$. The parameters, exponents, and coefficients of equation (31) may vary with oils. Moreover, the parameters, exponents, and coefficients of equation (31) can be treated as adjustable parameters that can be tuned according to the measurements performed at multiple downhole measurement stations.

In the illustrative embodiment, equation (31) is used to derive a predicted viscosity ($\eta$) at an additional measurement station based on the viscosity ($\eta_{ref}$) measured at the reference station in step 201, as well as asphaltene content (A, $A_0$), GOR ($R_s$, $R_{s0}$), temperature (T, $T_0$), and pressure (P, $P_0$) measured at the additional measurement station in step 207 and the reference measurement station in step 201, respectively. This can be repeated to derive a predicted viscosity ($\eta$) for multiple additional measurement stations. Alternatively, the asphaltene content (A), GOR ($R_s$), temperature (T), and pressure (P) for the additional measurement station(s) can be estimated from the results of the EOS model as described above. Moreover, asphaltene content ($A_0$), GOR ($R_{s0}$), temperature ($T_0$), and pressure ($P_0$) for the reference station can be estimated globally and possibly refined based on measurements of compositions at the reference station. Additionally, one could use a combination of measured and estimated values. For example, temperature and pressure can be measured, while asphaltene content and GOR can be estimated.

In step 213, the difference between the predicted viscosity generated in step 211 and the measured viscosity for the additional station(s) as measured in step 207 is calculated and stored for subsequent analysis. In the preferred embodiment, two differences are computed here. The first difference is based on the predicted viscosity generated in step 211 from measured values of asphaltene content (A), GOR, temperature, and pressure. The second difference is based on the predicted viscosity generated in step 211 from at least one value of asphaltene content (A), GOR, temperature, and pressure estimated from the EOS model.

In step 215, a model that characterizes the relationship between live fluid density and asphaltene content (and possibly other fluid parameters such as GOR, temperature, and pressure) at different measurement stations is used to calculate a predicted live fluid density for the measurement station(s) of step 207. The predicted live fluid density is preferably derived relative to the reference live fluid density measurement of step 201 in accordance the asphaltene content measurements (and possibly other fluid parameters) of steps 201 and 207. The model of step 215 assumes that the reservoir fluids are connected (i.e., there is a lack of compartmentalization) and in thermodynamic equilibrium.

In the illustrative embodiment of the invention, the model of step 215 can treat the reservoir oil as two components, an asphaltene component and a maltene component, and assume that the density of the asphaltene component ($\rho_A$ for the asphaltene component) is constant throughout the reservoir. Asphaltenes (the asphaltene component) exist in crude oil reservoirs as nanoaggregates, clusters, or single molecules and are known to have a density of 1.2 g/cc. Thus, $\rho_A$ can be set to 1.2 g/cc. The maltene component (oil after removal of asphaltenes) can vary greatly in density, so a measurement technique for the maltene density $\rho_M$ is required. For example, the maltene density $\rho_M$ can be derived from an equation of state, from live density measurements at one or more measurement stations, from a correlation to absorption spectra at one or more measurement stations, from a pressure-depth relation (pressure-gradient, pretest data), etc. Hence, the density of an oil can be treated as a non-interacting, two component (asphaltene/maltene) system as follows:

$$\frac{1}{\rho_{oil}} = \frac{A}{\rho_A} + \frac{(1-A)}{\rho_M}. \tag{32}$$

In equation (32), $\rho_{oil}$ is the density of the oil, $\rho_A$ is the density of the asphaltene component, $\rho_M$ is the maltene density, and A is the weight fraction of the asphaltene component in the oil. The variation in density within a reservoir again comes from the variation in asphaltene weight fraction.

Equation (32) can be rearranged to express the density of a live oil sample in terms of the density of a reference oil sample collected elsewhere in the reservoir:

$$\frac{\rho_{oil}}{\rho_{oil0}} = \frac{\dfrac{A_0}{\rho_A} + \dfrac{(1-A_0)}{\rho_M}}{\dfrac{A}{\rho_A} + \dfrac{(1-A)}{\rho_M}}. \tag{33}$$

In equation (33), $\rho_{oil}$ is the density of the live oil sample and A is the weight fraction of the asphaltene component in the live oil sample. $\rho_{oil0}$ is the density of the reference oil sample and $A_0$ is the weight fraction of the asphaltene component in the reference oil sample. $\rho_A$ is the density of the asphaltene component, which is constant over the reservoir. $\rho_M$ is the density of the maltene component, which may also be constant over the reservoir or may vary with depth.

Equation (33) again assumes a constant GOR, pressure, and reservoir temperature. If these assumptions do not hold, equation (33) can be corrected as follows:

$$\frac{\rho_{oil}}{\rho_{oil0}} = \left(\frac{R_{s0}}{R_s}\right)^{\alpha} \exp[-\beta(T-T_0)]\exp[c_o(P-P_0)]. \tag{34}$$

In equation (34), $R_s$, T, and P are the GOR in scf/stb, temperature in R, and pressure in psia, respectively of the live oil sample, while $R_{s0}$, $T_0$, and $P_0$ are the GOR in scf/stb, temperature in R, and pressure in psia, respectively of the reference oil sample. $\alpha$ is a parameter, which by default can be set to 0.20. $\beta$ is the isobaric thermal expansion coefficient of the fluid, which by default can be set to $5\times10^{-4}$ 1/K. $c_o$ denotes compressibility, which is estimated by the correlation of McCain, Rollins and Villena (1988) as follows:

$$c_o = \exp\{-7.633 - 1.497 \ln P + 1.115 \ln T + 0.533 \ln API + 0.184 \ln R_s\}. \tag{35}$$

The API term is a small contribution in the equation (35). For a first approximation, the API term can be estimated as:

$$\text{API} = 0.06R_s + 10;\ R_s \leqq 10000 \text{ scf/stb} \tag{36A}$$

$$\text{API} = 70R_s > 10000 \text{ scf/stb} \tag{36B}$$

The exponents and coefficients of equations (34-36) may vary with oils. Moreover, the exponents and coefficients of equations (34-36) can be treated as adjustable parameters that can be tuned according to the measurements performed at multiple downhole measurement stations.

Combining equations (33) and (34) provides an exemplary model that characterizes how the density in reservoir fluids varies as a function of asphaltene content (A, $A_0$), GOR ($R_s$, $R_{s0}$), temperature (T, $T_0$), and pressure (P, $P_0$) as follows:

$$\frac{\rho_{oil}}{\rho_{oil0}} = \frac{\dfrac{A_0}{\rho_A} + \dfrac{(1-A_0)}{\rho_M}}{\dfrac{A}{\rho_A} + \dfrac{(1-A)}{\rho_M}} \left(\frac{R_{s0}}{R_s}\right)^{\alpha} \exp[-\beta(T-T_0)]\exp[c_o(P-P_0)]. \tag{37}$$

This model assumes that the reservoir fluids are connected (i.e., there is a lack of compartmentalization) and in thermodynamic equilibrium. The exponents and coefficients of equation (37) may vary with oils. Moreover, the exponents and coefficients of equation (37) can be treated as adjustable parameters that can be tuned according to the measurements performed at multiple downhole measurement stations.

In the illustrative embodiment, equation (37) is used to derive a predicted live fluid density ($\rho_{oil}$) at an additional measurement station based on the live fluid density ($\rho_{oil0}$)

measured at the reference station in step 201 as well as asphaltene content (A, $A_0$), GOR ($R_s$, $R_{s0}$), temperature (T, $T_0$), and pressure (P, $P_0$) measured at the additional measurement station in step 207 and the reference measurement station in step 201, respectively. This can be repeated to derive a predicted live fluid density ($\rho_{oil}$) for multiple additional measurement stations. Alternatively, the asphaltene content (A), GOR ($R_s$), temperature (T), and pressure (P) for the additional measurement station(s) can be estimated from the results of the EOS model as described above. Moreover, asphaltene content ($A_0$), GOR ($R_{s0}$), temperature ($T_0$), and pressure ($P_0$) for the reference station can be estimated globally and possibly refined based on measurements of compositions at the reference station. Additionally, one may use a combination of measured and estimated values. For example, temperature and pressure can be measured, while asphaltene content and GOR can be estimated.

In step 217, the difference between the predicted live fluid density generated in step 215 and the measured live fluid density for the additional station(s) as measured in step 207 is calculated and stored for subsequent analysis. In the preferred embodiment, two differences are computed here. The first difference is based on the predicted density generated in step 215 from measured values of asphaltent content (A), GOR, temperature, and pressure. The second difference is based on the predicted density generated in step 215 from at least one value of asphaltene content (A), GOR, temperature, and pressure as estimated from the EOS model.

In step 219, the difference results of steps 213 and/or 217 is (are) evaluated to determine quantitative consistency between the asphaltene content, GOR, fluid density, and/or fluid viscosity measurements at the reference station at such measurement stations. Preferably, this is accomplished by checking whether the difference results of steps 213 and/or 217 are less than a corresponding threshold parameter. If so, the consistency check of step 219 passes and the operations continue to step 221. Otherwise, the consistency check of step 219 fails and the operations continue to step 225.

For the case where the consistency check of step 219 passes, it is determined if there is a need for additional measurement stations and/or different methodologies (step 221) for repeat processing and analysis in order to improve the confidence level of the measured and/or predicted fluid properties (step 224). For example, the measured and/or predicted properties of the reservoir fluid can be compared to a database of historical reservoir data to determine the measured and/or predicted properties make sense. If the data does not make sense, additional measurement station(s) or different methodologies (e.g., different model(s)) can be identified for repeat processing and analysis in order to improve the confidence level of the measured and/or predicted fluid properties (step 224).

Other factors can be used to determine if there is a need for additional measurement stations and/or different methodologies for repeat processing and analysis in order to improve the confidence level of the measured and/or predicted fluid properties. For example, in step 221, it is expected that the reservoir is connected and in thermodynamic equilibrium. Thus, the measured fluid properties can be accessed to confirm that they correspond to this expected architecture. More specifically, connectivity can be indicated by moderately decreasing GOR values with depth, a continuous increase of asphaltene content as a function of depth, and/or a continuous increase of fluid density and/or fluid viscosity as a function of depth. On the other hand, compartmentalization and/or non-equilibrium can be indicated by discontinuous GOR (or if lower GOR is found higher in the column), discontinuous asphaltene content (or if higher asphaltene content is found higher in the column), and/or discontinuous fluid density and/or fluid viscosity (or if higher fluid density and/or fluid viscosity is found higher in the column).

If in step 221, if there is no need for additional measurement stations and/or different methodologies (in other words, there is sufficient confidence level in the measured and/or predicted fluid properties), the operation continues to step 223 where the reservoir architecture is determined to be connected and in thermodynamic equilibrium. Such a determination is supported by the consistency check of step 219 that confirms the validity of the assumptions of reservoir connectivity and thermal equilibrium that underlie the models utilized for predicting fluid density and/or fluid viscosity within the reservoir. Verifying that asphaltene content, GOR, density, and/or viscosity all change as expected with depth in the reservoir provides a more confident assessment of connectivity than is possible by verifying expected changes in only asphaltene content and/or GOR as is current practice. Additionally, verifying that the changes in density and viscosity, which depend on asphaltene content and GOR, are consistent with measured and predicted changes in asphaltene content and GOR provides even more confidence in the accuracy of the measurements and in the claim of reservoir connectivity.

In step 224, one or more additional measurement stations are added to the workflow for processing as described herein. Adding additional measurement stations to the workflow allows for additional tuning of the model of the workflow in order to improve the accuracy of the compositional and fluid property analysis of the reservoir as provided by the workflow.

For the case where the consistency check of step 219 fails, it is determined if there is a need for additional measurement stations and/or different methodologies (step 225) for repeat processing and analysis in order to improve the confidence level of the measured and/or predicted fluid properties (step 228). For example, the measured and/or predicted properties of the reservoir fluid can be compared to a database of historical reservoir data to determine the measured and/or predicted properties make sense. If the data does not make sense, additional measurement station(s) or different methodologies (e.g., different model(s)) can be identified for repeat processing and analysis in order to improve the confidence level of the measured and/or predicted fluid properties (step 228).

Other factors can be used to determine if there is a need for additional measurement stations and/or different methodologies for repeat processing and analysis in order to improve the confidence level of the measured and/or predicted fluid properties. For example, in step 225, it is expected that the reservoir is compartmentalized or not in thermodynamic equilibrium. Thus, the measured fluid properties can be accessed to confirm that they correspond to this expected architecture. More specifically, compartmentalization and/or non-equilibrium can be indicated by discontinuous GOR (or if lower GOR is found higher in the column), discontinuous asphaltene content (or if higher asphaltene content is found higher in the column), and/or discontinuous fluid density and/or fluid viscosity (or if higher fluid density and/or fluid viscosity is found higher in the column). On the other hand, connectivity can be indicated by moderately decreasing GOR values with depth, a continuous increase of asphaltene content as a function of depth, and/or a continuous increase of fluid density and/or fluid viscosity as a function of depth.

If in step 225, if there is no need for additional measurement stations and/or different methodologies (in other words, there is sufficient confidence level in the measured and/or predicted fluid properties), the operation continue to steps 227 where the reservoir architecture is determined to be compartmentalized and/or not in thermodynamic equilibrium, or that a tool failure is indicated. Such a determination is supported by the consistency check of step 219 that confirms the invalidity of the assumptions of reservoir connectivity and thermal equilibrium that underlie the models utilized for predicting fluid density and/or fluid viscosity within the wellbore.

In step 228, one or more additional measurement stations are added to the workflow for processing as described herein in order to better understand and resolve inconsistencies, if possible. Moreover, by adding additional measurement stations to the workflow, the failed consistency check can cause additional tuning of the models of the workflow in order to improve the accuracy of the compositional and fluid property analysis of the reservoir as provided by the workflow.

Subsequent to the determination of reservoir architecture in steps 223 and 227, the results of such determination are reported to interested parties in step 229. The characteristics of the reservoir architecture reported in step 229 can be used to model and/or understand the reservoir of interest for reservoir assessment, planning and management.

In the workflow described above, the consistency check of step 219 can be used to determine whether additional measurements are needed. Differences between measured and predicted values of asphaltene content, GOR, density, and/or viscosity greater than threshold can result from compartmentalization, lack of equilibrium, or measurement inaccuracy. Consistency checks between these four measurements can be used to identify the cause of the beyond-threshold difference(s), because density and viscosity depend on asphaltene content and on GOR.

For example, consider a situation in which at a particular measurement station the measured and predicted values of GOR agree while the predicted and measured values of asphaltene content disagree beyond threshold. Under current practice, this situation typically would be interpreted as suggesting compartmentalization or lack of equilibrium. In accordance with the present invention, density and viscosity are measured and predicted at that same measurement station. The predicted values of density and viscosity depend on asphaltene content and on GOR. The differences between the measured and predicted values of density and viscosity are then used to differentiate between certain reservoir architecture (reservoir compartmentalization or lack of equilibrium) and the case of measurement inaccuracy.

In the preferred embodiment, the predictions of density and viscosity are generated in two ways. First, density and viscosity at the measurement station are predicted using measured values of asphaltene content (A) and GOR at that measurement station. Second, density and viscosity at the measurement station are predicted using values of asphaltene content (A) and GOR at that measurement station estimated from the EOS. The differences ("first differences") between the measured values of density and viscosity and the predicted values of density and viscosity derived from the measured values of asphaltene content and GOR are calculated and compared against threshold levels. Similarly, the differences ("second differences") between the measured values of density and viscosity and the predicted values of density and viscosity derived from the values of asphaltene content and GOR estimated from the EOS are calculated and compared against threshold levels. In the event that the first differences fall outside the corresponding threshold levels yet the second differences fall within the corresponding threshold levels, it is likely that that the measured value of asphaltene content is inaccurate. In this case, additional measurements of asphaltene content may be required to determine if other asphaltene content measurements are inaccurate. Potentially the methodology would be altered such that inaccurate asphaltene measurements would be omitted from the workflow.

Thus, the present invention provides for examining trends in asphaltene content, GOR, density, and/or viscosity (rather than just asphaltene content and GOR as is current practice), and especially by making quantitative consistency checks among these measurements to identify potential measurement inaccuracy. In this manner, the workflow can differentiate between certain reservoir architecture (reservoir compartmentalization or lack of equilibrium) and the case of measurement inaccuracy, and provide a more confident assessment of certain reservoir architectures (i.e., compartmentalization or lack of equilibrium) than is possible using current practice.

There have been described and illustrated herein a preferred embodiment of a method, system, and apparatus for downhole fluid analysis of the fluid properties of a reservoir of interest and for characterizing the reservoir of interest based upon such downhole fluid analysis. While particular embodiments of the invention have been described, it is not intended that the invention be limited thereto, as it is intended that the invention be as broad in scope as the art will allow and that the specification be read likewise. Thus, while particular empirical models that characterize relative density and relative viscosity with asphaltene content, GOR, temperature, and pressure have been disclosed, it will be appreciated that other suitable models that characterize density, viscosity, or other measured fluid property as a function of asphaltene content, GOR, temperature, and pressure at different measurement stations can be employed as well. In addition, while particular formulations of empirical relations have been disclosed with respect to a particular model, it will be understood that other empirical relations with regard to the same or other models can be used. Furthermore, while particular data processing methodologies and systems have been disclosed, it will be understood that other suitable data processing methodologies and systems can be similarly used. Also, while particular equation of state models and applications of such EOS have been disclosed for predicting properties of reservoir fluid, it will be appreciated that other equations of state and applications thereof could be used as well. Moreover, the methodology described herein is not limited to stations in the same wellbore. For example, measurements from samples from different wells can be analyzed as described herein for testing for lateral connectivity. It will therefore be appreciated by those skilled in the art that yet other modifications could be made to the provided invention without deviating from its scope as claimed.

What is claimed is:

1. A method for characterizing petroleum fluid in a reservoir traversed by at least one wellbore, the method comprising:

(a) at a plurality of measurement, stations within the at least one wellbore, acquiring at least one fluid sample at the respective measurement station and performing downhole fluid analysis of the fluid sample to measure properties of the fluid sample, the properties including asphaltene content and at least one other fluid property;

(b) using at least one model that characterizes the relationship between a particular fluid property and asphaltene content at different measurement stations to calculate a predicted value of the particular fluid property for at least one given measurement station of said plurality of measurement stations, wherein the at least one model comprises a first model that characterizes the relationship between viscosity and asphaltene content at different measurement stations to calculate a predicted value of fluid viscosity for at least one given measurement station;

(c) performing a consistency check involving comparison of the predicted value of the particular fluid property for the at least one given measurement station with the corresponding fluid property measured by the downhole fluid analysis for the at least one given measurement station; and (d) using the results of the consistency check for reservoir analysis.

2. A method according to claim 1, wherein in (d), the results of the consistency check are used to determine reservoir architecture.

3. A method according to claim 2, wherein in (d), the results of the consistency check provide an indication of connectivity in the event that the consistency check passes.

4. A method according to claim 2, wherein in (d), the results of the consistency check provide an indication of compartmentalization or non-equilibrium in the event that the consistency check fails.

5. A method according to claim 1, wherein in (d), the results of the consistency check are used to determine whether or not to repeat the processing of (a) for one or more additional measurement stations.

6. A method according to claim 1, further comprising:

(e) inputting fluid sample properties measured in (a) to an equation of state model to predict compositional properties and fluid properties at different locations within the reservoir.

7. A method according to claim 6, further comprising;

(f) tuning the equation of state model of (e) based on fluid sample properties measured in (a).

8. A method according to claim 7, wherein:

in (d), the results of the consistency check are used to determine that the processing of (a) is to be repeated for one or more additional measurement, stations;

the processing of (a) is repeated for one or more additional measurement stations; and the tuning of (f) is based on the fluid sample properties measured at the one or more additional measurement stations.

9. A method according to claim 1, wherein the at least one model comprises a second model that characterizes the relationship between fluid density and asphaltene content at different measurement stations to calculate a predicted value of fluid density for at least one given measurement station.

10. A method according to claim 9, wherein:

the second model employs gas-oil ratio (GOR), temperature, and pressure measured by downhole fluid analysis at two different measurement stations.

11. A method for characterizing petroleum fluid in a reservoir traversed by at least one wellbore, the method comprising:

(a) at a plurality of measurement stations within the at least one wellbore, acquiring at least one fluid sample at the respective measurement station and performing downhole fluid analysis of the fluid sample to measure properties of the fluid sample, the properties including asphaltene content and at least one other fluid property;

(b) using at least one model that characterizes the relationship between a particular fluid property and asphaltene content at different measurement stations to calculate a predicted value of the particular fluid property for at least one given measurement station of said plurality of measurement stations, wherein the at least one model comprises a first model that characterizes the relationship between fluid density and asphaltene content at different measurement stations to calculate a predicted value of fluid density for at least one given measurement station, the first model employing gas-oil ratio (GOR), temperature, and pressure measured by downhole fluid analysis at two different measurement stations; and wherein the first model is based on a mathematical relationship of the form $$\frac{\rho_{oil}}{\rho_{oil0}} = \frac{\frac{A_0}{\rho_A} + \frac{(1-A_0)}{\rho_M}}{\frac{A}{\rho_A} + \frac{(1-A)}{\rho_M}} \left(\frac{R_{s0}}{R_s}\right)^{\alpha} \exp[-\beta(T-T_0)]\exp[c_o(P-P_0)]$$

where $\rho_{oil}$ is the predicted fluid density at the given measurement station $ST_1$, $\rho_{oil0}$ is the measured fluid density at another measurement station $ST_0$, A, $R_s$, T, and P are the measured values of the asphaltene weight fraction, GOR (in scf/stb), temperature (in R), and pressure (in psia), respectively, of the fluid sample at the measurement, station $ST_1$;

$A_0$, $R_{s0}$, $T_0$, and $P_0$ are the measured values of the asphaltene weight fraction, GOR (in scf/stb), temperature (in R), and pressure (in psia), respectively, of the fluid sample at the measurement station $ST_0$;

$\rho_A$ is the density of asphaltene for the reservoir fluids;

$\rho_M$ is the density of maltene for the reservoir fluids;

$\alpha$ is a parameter;

$\beta$ coefficient related to isobaric thermal expansion of the reservoir fluid; and $c_o$ is a coefficient related to compressibility of the reservoir fluid;

(c) performing a consistency check involving comparison of the predicted value of the particular fluid property for the at least one given measurement station with the corresponding fluid property measured by the downhole fluid analysis for the at least one given measurement station; and (d) using the results of the consistency check for reservoir analysis.

12. A method according claim 1, wherein the first model employs gas-oil ratio (GOR), temperature, and pressure measured by downhole fluid analysis at two different measurement stations.

13. A method according to claim 12, wherein the first model is based on a mathematical relationship of the form $$\frac{\eta}{\eta_{ref}} = \left[\frac{1-K'\cdot A}{1-K'\cdot A_0}\right]^{-\nu} \left(\frac{R_{s0}}{R_s}\right)^{\alpha} \left(\frac{T_0}{T}\right)^{\beta} \exp[\gamma(P-P_0)]$$

where $\eta$ is the predicted fluid viscosity at the given measurement station $ST_1$, $\eta_{ref}$ is the measured fluid viscosity at another measurement station $ST_0$, A, $R_s$, T, and P are the measured values of the asphaltene weight fraction, GOR (in scf/stb), temperature (in R), and pressure (in psia), respectively, of the fluid sample at the measurement station $ST_1$;

$A_0$, $R_{s0}$, $T_0$, and $P_0$ are the measured values of the asphaltene weight fraction, GOR, (in scf/stb), temperature (in R), and pressure (in psia), respectively, of the fluid sample at the measurement station $ST_0$; and the solvation constant K', ν, α, β, and γ are parameters.

14. A method for characterizing petroleum fluid in a reservoir traversed by at least one wellbore, the method comprising:

(a) at a plurality of measurement stations within the at least one wellbore, acquiring at least one fluid sample at the respective measurement station and performing downhole fluid analysis of the fluid sample to measure properties of the fluid sample, the properties including asphaltene content, gas-oil ratio (GOR), fluid density, and fluid viscosity;

(b) using a first model that characterizes the relationship between fluid viscosity, asphaltene content, and GOR at different measurement stations to calculate first and second predicted values of fluid viscosity for at least one given measurement station of said plurality of measurement stations, the first predicted value of fluid viscosity derived from asphaltene content and GOR measured at the given measurement station, and the second predicted, value of fluid viscosity derived from estimates of asphaltene content and GOR at the given measurement station;

(c) using a second model that characterizes the relationship between fluid density, asphaltene content, and GOR at different measurement stations to calculate first and second predicted values of fluid density for the given measurement station, the first predicted value of fluid density derived from asphaltene content and GOR measured at the given measurement station, and the second predicted value of fluid density derived from estimates of asphaltene content and GOR at the given measurement station;

(d) performing a consistency check involving the first and second predicted values of fluid viscosity as well as the first and second predicted values of fluid density; and (e) using the results of the consistency check for reservoir analysis.

15. A method according claim 14, wherein:

the consistency check of (d) includes first, second, third, and fourth comparisons;

wherein the first comparison compares the first predicted value of fluid viscosity for the given measurement station with the fluid viscosity measured by the downhole fluid analysis for the given measurement station;

wherein the second comparison compares the second predicted value of fluid, viscosity for the given measurement station with the fluid viscosity measured by the downhole fluid analysis for the given measurement station;

wherein the third comparison compares the first predicted value of fluid density for the given measurement station with the fluid density measured by the downhole fluid analysis for the given measurement station; and wherein the fourth comparison compares the second predicted value of fluid density for the given measurement station with the fluid density measured by the downhole fluid analysis for the given measurement station.

16. A method according to claim 14, wherein in (e), the results of the consistency check are used to determine reservoir architecture.

17. A method according to claim 16, wherein in (e), the results of the consistency check provide an indication of connectivity in the event that the consistency check passes.

18. A method according to claim 16, wherein in (e), the results of the consistency check provide an indication of compartmentalization or non-equilibrium in the event that the consistency check fails.

19. A method according to claim 14, wherein in (e), the results of the consistency check are used to determine whether or not to repeat the processing of (a) for one or more additional measurement stations.

20. A method according to claim 14, further comprising:

(f) inputting fluid sample properties measured in (a) to an equation of state model to predict compositional properties and fluid properties at different locations within the reservoir, wherein the equation of state model is used to generate estimates of asphaltene content and GOR at the given measurement station for use in calculating the second predicted value of fluid density for the given measurement station as well as in calculating the second predicted value of fluid viscosity at the given measurement station.

21. A method according to claim 20, further comprising:

(g) tuning the equation of state model of (f) based on fluid sample properties measured in (a).

22. A method according to claim 21, wherein:

in (e), the results of the consistency check are used to determine that the processing of (a) is to be repeated for one or more additional measurement stations;

the processing of (a) is repeated for one or more additional measurement stations; and the tuning of (g) is based on the fluid sample properties measured at the one or more additional measurement stations.

23. A method according to claim 14, wherein the first and second models each employ GOR, temperature, and pressure measured by downhole fluid analysis at two different measurement stations.

24. A method according to claim 23, wherein:

the first model is based on a mathematical relationship of the form $$\frac{\rho_{oil}}{\rho_{oil0}} = \frac{\frac{A_0}{\rho_A} + \frac{(1-A_0)}{\rho_M}}{\frac{A}{\rho_A} + \frac{(1-A)}{\rho_M}} \left(\frac{R_{s0}}{R_s}\right)^{\alpha} \exp[-\beta(T-T_0)]\exp[c_o(P-P_0)]$$

where $\rho_{oil}$ is the predicted fluid density at the given measurement station $ST_1$, $\rho_{oil0}$ is the measured fluid density at another measurement station $ST_0$, A, $R_s$, T, and P are the measured values of the asphaltene weight fraction, GOR (in scf/stb), temperature (in R), and pressure (in psia), respectively, of the fluid sample at the measurement station $ST_1$;

$A_0$, $R_{s0}$, $T_0$, and $P_0$ are the measured values of the asphaltene weight fraction, GOR (in scf/stb), temperature (in R), and pressure (in psia), respectively, of the fluid sample at the measurement station $ST_0$;

$\rho_A$ is the density of asphaltene for the reservoir fluids;

$\rho_M$ is the density of maltene for the reservoir fluids;

α is a parameter;

β is a coefficient related to isobaric thermal expansion of the reservoir fluid; and $c_o$ is a coefficient related to compressibility of the reservoir fluid.

25. A method according to claim 23, wherein:

the second model is based on a mathematical relationship of the form $$\frac{\eta}{\eta_{ref}} = \left[\frac{1 - K' \cdot A}{1 - K' \cdot A_0}\right]^{-\nu} \left(\frac{R_{s0}}{R_s}\right)^{\alpha} \left(\frac{T_0}{T}\right)^{\beta} \exp[\gamma(P - P_0)]$$

where $\eta$ is the predicted fluid viscosity at the given measurement station $ST_1$, $\eta_{ref}$ is the measured fluid viscosity at another measurement station $ST_0$, A, $R_s$, T, and P are the measured values of the asphaltene weight fraction, GOR (in scf/stb), temperature (in R), and pressure (in psia), respectively, of the fluid sample at the measurement station $ST_1$;

$A_0$, $R_{s0}$, $T_0$, and $P_0$ are the measured values of the asphaltene weight fraction, GOR (in scf/stb), temperature (in R), and pressure (in psia), respectively, of the fluid sample at the measurement station $ST_0$; and the solvation constant K', $\nu$, $\alpha$, $\beta$, and $\gamma$ are parameters.

* * * * *